US011021904B2

(12) United States Patent
Trask

(10) Patent No.: US 11,021,904 B2
(45) Date of Patent: Jun. 1, 2021

(54) VEHICLE DOOR WINDOW POSITION CONTROL SYSTEM

(71) Applicant: Brose Fahrzeugteile GmbH & Co. Kommanditgesellschaft, Bamberg, Bamberg (DE)

(72) Inventor: Robert Trask, Waterford, MI (US)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 197 days.

(21) Appl. No.: 16/368,332

(22) Filed: Mar. 28, 2019

(65) Prior Publication Data

US 2020/0308894 A1 Oct. 1, 2020

(51) Int. Cl.
*E05F 15/70* (2015.01)
*E05F 15/73* (2015.01)
*E05F 15/695* (2015.01)

(52) U.S. Cl.
CPC ..... *E05F 15/70* (2015.01); *E05F 15/695* (2015.01); *E05F 15/73* (2015.01); *E05Y 2400/415* (2013.01); *E05Y 2400/452* (2013.01); *E05Y 2900/55* (2013.01)

(58) Field of Classification Search
USPC ..... 318/264, 255, 256
See application file for complete search history.

(56) References Cited

U.S. PATENT DOCUMENTS 6,166,508 A * 12/2000 Kalb ..... E05F 15/70 318/286
6,759,817 B2 * 7/2004 Mersch ..... E05F 15/695 318/34
7,388,339 B2 * 6/2008 Held ..... G05B 9/02 318/266
7,770,327 B2 * 8/2010 Noro ..... E05F 15/695 49/349
8,291,645 B2 * 10/2012 Hohn ..... E05F 15/695 49/506
8,355,845 B2 1/2013 Kalb
8,590,210 B2 * 11/2013 Schindhelm ..... E05F 15/70 49/506
9,033,394 B2 * 5/2015 Heirtzler ..... B60J 10/79 296/146.2
10,814,702 B2 * 10/2020 Aoki ..... E05F 15/689
(Continued)

FOREIGN PATENT DOCUMENTS

DE 19836761 C1 7/1999

*Primary Examiner* — David Luo
(74) *Attorney, Agent, or Firm* — Brooks Kushman P.C,

(57) ABSTRACT

A frameless vehicle door includes a window pane, a regulator motor, and a controller. The window pane is configured to being movable between at least a first and a second open position and a closed position. The window pane is configured to extend upward from a top of the door and into a vehicle frame when the window pane is in the closed position. The regulator motor is disposed within the door and is configured to transition the window pane between the open positions and the closed position. The controller is programmed to, in response to a voltage of a battery, that is configured to power the regulator motor, decreasing to less than a threshold and the window pane being in the closed position, transition the window pane to the second open position that is between the first open position and the closed position.

18 Claims, 2 Drawing Sheets

(56) References Cited

U.S. PATENT DOCUMENTS

| | | | | |
|---|---|---|---|---|
| 2006/0254148 | A1* | 11/2006 | Noro | E05F 15/695 49/352 |
| 2009/0206784 | A1* | 8/2009 | Inoue | E05F 15/41 318/434 |
| 2011/0059341 | A1* | 3/2011 | Matsumoto | H01M 10/613 429/82 |
| 2012/0136532 | A1* | 5/2012 | Konchan | E05B 81/64 701/36 |
| 2012/0234621 | A1* | 9/2012 | Syvret | E05F 15/70 180/281 |
| 2014/0373446 | A1* | 12/2014 | Weidenbacher | E05F 15/74 49/31 |
| 2017/0362877 | A1* | 12/2017 | Bars | E05F 15/689 |
| 2020/0115950 | A1* | 4/2020 | Hattori | E05F 15/72 |

* cited by examiner

VEHICLE DOOR WINDOW POSITION CONTROL SYSTEM

TECHNICAL FIELD

The present disclosure relates to vehicle door windows and systems for adjusting the position of vehicle door windows.

BACKGROUND

Vehicles doors may be designed without a window frame that extends over the top of the door. The window pane disposed within the door may extend upward from the door and engage a seal along the vehicle frame in order to transition the window to a closed position and isolate the interior of the vehicle from the outside environment. Such a door may be referred to as a frameless door.

SUMMARY

A frameless vehicle door includes a window pane, a regulator motor, and a controller. The window pane is configured to being movable between at least a first and a second open position and a closed position. The window pane is configured to extend upward from a top of the door and into a vehicle frame when the window pane is in the closed position. The regulator motor is disposed within the door and is configured to transition the window pane between the open positions and the closed position. The controller is programmed to, in response to a voltage of a battery, that is configured to power the regulator motor, decreasing to less than a threshold and the window pane being in the closed position, transition the window pane to the second open position that is between the first open position and the closed position.

A vehicle door window system includes a regulator motor and a controller. The regulator motor is configured to transition a window pane between at least a first and a second open position and a closed position. The window pane is configured to extend upward from a frameless door and into a vehicle frame when in the closed position. The controller is programmed to, in response to a voltage of a battery, that is configured to power the regulator motor, decreasing to less than a threshold and the window pane being in the closed position, operate the regulator motor to transition the window pane to the second open position that is between the first open position and the closed position.

A vehicle door window controller includes input channels, an output channel, and control logic. The input channels are configured to receive signals indicative of a position of a window pane that is disposed within a frameless door and a voltage of a battery that is configured to power a regulator motor to transition the window pane between at least a first and a second open position and a closed position. The output channel is configured to provide a command to adjust the position of the window pane from the closed position to the second open position that is between the first open position and the closed position. The control logic is programmed to, in response to receiving signals indicative of the window pane being in the closed position and the voltage decreasing to less than a threshold, issue the command.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
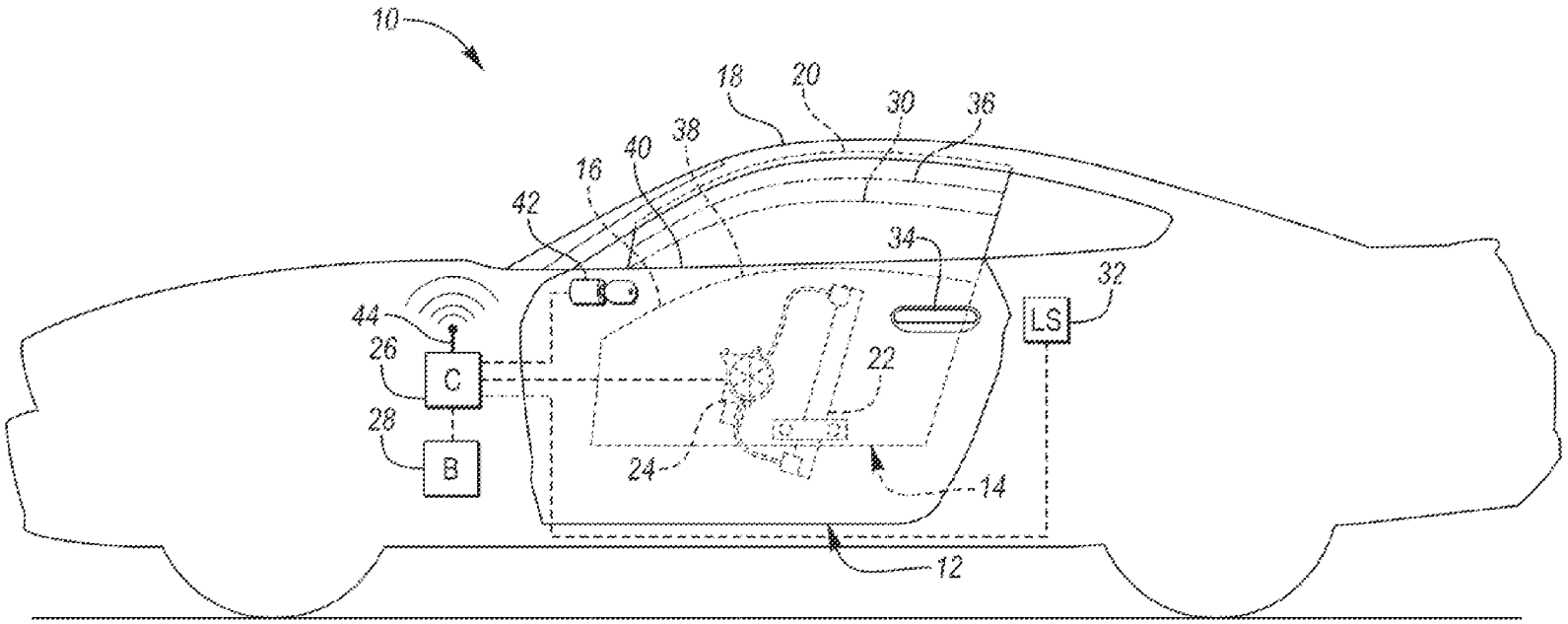
FIG. 1 is a schematic illustration of a representative vehicle having a frameless door that includes a window pane.

Referring to FIG. 1, a vehicle 10 having a frameless door 12 that includes a window pane 14 is illustrated. Like other vehicle doors, the frameless door 12 includes a window pane 14 that extends upward from the door when the window is in a closed position. The window pane 14 of the frameless door 12, however, is not received within an upper frame that extends upward from and is part of the door 14 when the window pane 14 is in the closed position. Instead, the window pane 14 is received within a portion of the vehicle frame when both the frameless door 12 is closed and the window pane 14 is in the closed position. A seal may be disposed between the vehicle frame and the window pane 14 when the window pane 14 is in the closed position in order to isolate the interior of the vehicle from the external conditions (e.g., rain, snow, cold air, hot air, etc.). Since the window pane 14 of the frameless door 12 is disposed within a portion of the vehicle frame when in a closed position, the window pane 14 may need to be transitioned to an opened position or at least a partially opened position when the frameless door 12 is either opening or closing in order to prevent any interference between the window pane 14 and the vehicle frame. Such interference, when the frameless door 12 is either opening or closing, could damage the window pane, which may result in requiring that the window be replaced.

The window pane 14 is disposed within the frameless door 12 when in the window pane 14 is in a fully open (or fully down) position 16. The window pane 14 is configured to extend upward from a top of the frameless door 12 and into a frame 18 of the vehicle 10 when the window pane 14 is transitioned from the fully open position 16 and into a closed (or fully up) position 20. The specific portion of the vehicle frame 18 that the window pane 14 extends into, when in the closed position 20, may be a roof rail and/or a pillar (e.g., A-pillar or B-pillar). The window pane 14 may be secured to sliding mechanism 22 that is disposed within the frameless door 12. The sliding mechanism 22 allows the window pane 14 to transition between the fully open position 16 and the closed position 20. A regulator motor 24 is also disposed within the frameless door 12. The regulator motor 24 is configured to transition the window pane 14 between the fully open position 16 and the closed position 20 along the sliding mechanism 22. The regulator motor 24 may adjust Bowden cables that are secured to the sliding mechanism 22 in order to transition the window pane 14 between the fully open position 16 and the closed position 20. The disclosure should not be construed as limited to the sliding mechanism 22 depicted in FIG. 1. For example, the door window system (which includes the window pane 14, sliding mechanism 22, regulator motor 24, and an associated controller) may include a scissor type lifting mechanism that is configured to transition the window pane 14 between the fully open position 16 and closed position 20 as opposed to the sliding mechanism 22.

An associated controller 26 may be configured to operate the regulator motor 24 in order to transition the window pane 14 between the fully open position 16 and the closed position 20. A door window switch (not shown) may be disposed within the cabin of the vehicle 10. A vehicle operator may interact with the door window switch in order to transition the window pane 14 between the fully open position 16 and the closed position 20. The controller 26 may be configured to direct power from a battery 28 to the regulator motor 24 in order to transition the window pane 14 between the fully open position 16 and the closed position 20. The controller 26 may also operate the regulator motor 24 in order to transition window pane 14 to any partially open position that is between the fully open position 16 and closed position 20. The controller 26 may transition the window to any partially open position in response to an operator interacting with the window switch to partially open the window pane 14. The controller 26 may track the position of the window pane 14 based on the indexing position of the regulator motor 24. Alternatively, sensors may be disposed within the frameless door 12 that track the position of the window pane 14 and communicate the position of the window pane 14 back to the controller 26.

Alternatively, the controller 26 may include control logic and/or an algorithm that may automatically transition the window pane 14 to a partially open position under certain conditions. For example, the controller 26 may transition the window pane 14 to a first partially open position 30 in response to receiving a signal indicative that the frameless door 12 is about to be opened so that window pane 14 is sufficiently clear of the vehicle frame 18 and so that the frameless door 12 may be opened without damaging the window pane 14. A micro switch or limit switch 32 may be connected to a door handle 34 or to the latching mechanism of the frameless door 12. The limit switch 32 may relay such a signal to the controller 26 that the frameless door 12 is about to be opened in response to a vehicle operator engaging the door handle 34. The signal that the frameless door 12 is about to be opened may be relayed while the operator is engaging the door handle 34, but before the door handle 34 has been engaged to the point where the frameless door 12 actually begins to open. Additionally, or in the alternative, a signal from a wireless key fob or a signal from a sensor (e.g., a sonic, infrared, radar, etc. sensor) that is configured to detect hand gestures from a vehicle operator may relay such a signal to the controller 26 that the frameless door 12 is about to be opened As another example, the controller 26 may transition the window pane 14 to a second partially open position 36 that is between the first partially open position 30 and the closed position 20. When they window pane 14 is in the second partially open position 36, there is enough clearance between the window pane 14 and the vehicle frame 18 to prevent interference between the window pane 14 and the vehicle frame 18. However, in the second partially open position 36 the window pane 14 is sufficiently close enough to the vehicle frame 18 to better isolate the interior of the vehicle from the external conditions relative to when the window pane 14 is in the first partially open position 30. When the window pane 14 is in any of the partially open positions (e.g., first partially open position 30 or second partially open position 36) a top 38 of the window pane 14 may be disposed below the vehicle frame 18. Also, when the window pane 14 is in any of the partially open positions at least a portion of the top 38 of the window pane 14 may be disposed above the top 40 of the frameless door 12.

The controller 26 may also be in communication with an ignition switch 42 of the vehicle 10. The ignition switch 42 may transition the vehicle 10 between an "on" state and an "off" state (i.e., where the vehicle 10 has been shut down). The ignition switch 42 may communicate to the controller 26 whether the vehicle 10 is in the "on" state or if the vehicle 10 has been shut down. A vehicle user may not operate (e.g., shift the gears of the transmission or depress the accelerator pedal to accelerate the vehicle) the vehicle 10 unless the vehicle 10 is in the "on" state. The controller 26 may also include a receiver 44 that is configured to receive wireless communication (e.g., Bluetooth, radio, dedicated short range communications, etc.). For example, the controller 26 may receive information, via the receiver 44, that is indicative that the vehicle 10 has entered into a covered position or structure. The vehicle 10 may be in a covered position when the vehicle 10 has entered a building that protects the vehicle 10 from the outside elements. For example, the building may include a roof that protects the vehicle from rain and snow. The vehicle 10 may receive such information from other vehicles, the infrastructure, or any other source. Alternatively, the vehicle 10 may include sensors (e.g., sonic, infrared, radar, etc. sensors) that are disposed on the vehicle 10 itself that are configured to detect whether or not the vehicle 10 has entered into a covered position or structure.

While illustrated as one controller, the controller 26 may be part of a larger control system and may be controlled by various other controllers throughout the vehicle 10, such as a vehicle system controller (VSC). It should therefore be understood that the controller 26 and one or more other controllers can collectively be referred to as a "controller" that controls various actuators in response to signals from various sensors to control functions the vehicle 10 or vehicle subsystems. The controller 26 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 26 in controlling the vehicle 10 or vehicle subsystems.

Control logic or functions performed by the controller 26 may be represented by flow charts or similar diagrams in one or more figures. These figures provide representative control strategies and/or logic that may be implemented using one or more processing strategies such as event-driven, interruptdriven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description.

The control logic may be implemented primarily in software executed by a microprocessor-based vehicle, engine, and/or powertrain controller, such as controller 26. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of a number of known physical devices which utilize electric, magnetic, and/or optical storage to keep executable instructions and associated calibration information, operating variables, and the like.

The controller 26 may be configured to receive various states or conditions of the various vehicle components illustrated in FIG. 1 via electrical signals. The electrical signals may be delivered to the controller 26 from the various components via input channels. Additionally, the electrical signals received from the various components may be indicative of a request or a command to change or alter a state of one or more of the respective components of the vehicle 10. The controller 26 includes output channels that are configured to deliver requests or commands (via electrical signals) to the various vehicle components. The controller 26 includes control logic and/or algorithms that are configured to generate the requests or commands delivered through the output channels based on the requests, commands, conditions, or states of the various vehicle components. The input channels and output channels are illustrated as dotted lines in FIG. 1. It should be understood that a single dotted line may be representative of one or more input channels and one or more output channels into or out of a single element. Furthermore, an output channel out of one element may operate as an input channel to another element and vice versa. The input and output channels may include hard wired connections or wireless connections.

Figure 2:
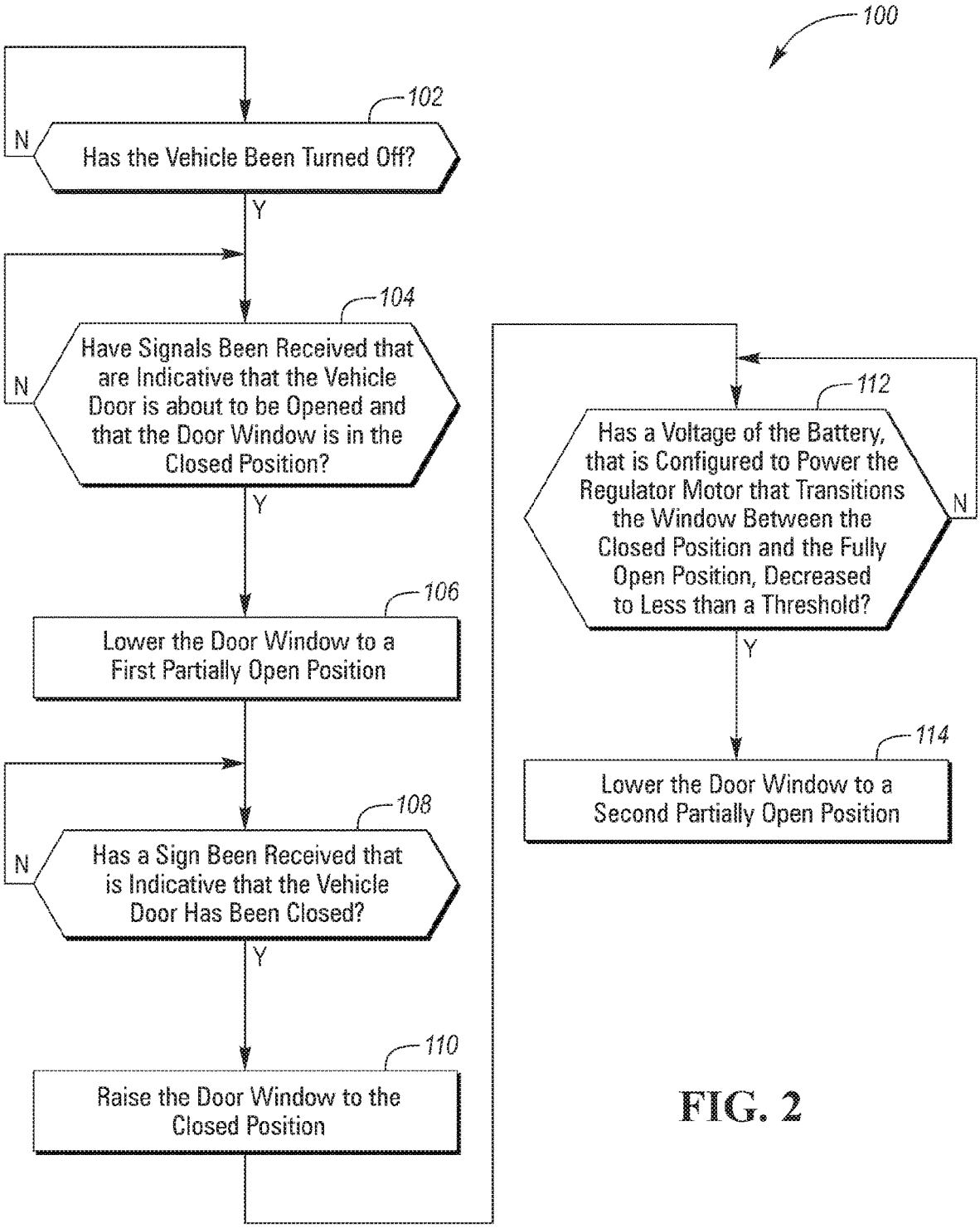
FIG. 2 is a flowchart illustrating a method of controlling the position of the window pane.

Referring to FIG. 2, a method 100 of controlling the position of the door window pane 14 is illustrated. The method 100 may be stored as control logic and/or an algorithm within the controller 26. The controller 26 may implement the method 100 by controlling the various components of the vehicle 10. More specifically, the controller may receive and transmit signals via the input and output channels in order to implement the method 100. The method 100 begins at block 102 where it is determined if the vehicle 10 has been turned off (i.e., whether the vehicle 10 has been shut down). If the vehicle 10 has not been shut down the method 100 recycles back to the beginning of block 102. If the vehicle 10 has been shut down, the method moves on to block 104. At block 104 it is determined if signals have been received by the controller 26 that are indicative that the vehicle frameless door 12 is about to be opened and that the door window pane 14 is in the closed position 20. If the signals that are indicative that the vehicle frameless door 12 is about to be opened and that the door window pane 14 is in the closed position 20 are not received by the controller 26, the method 100 recycles back to the beginning of block 104. If the signals that are indicative that the vehicle frameless door 12 is about to be opened and that the door window pane 14 is in the closed position 20 are received by the controller 26, the method 100 moves on to block 106 where the door window pane 14 is lowered from the closed position 20 to the first partially open position 30.

Once the door window pane 14 is lowered from the closed position 20 to the first partially open position 30 at block 106 the method 100 moves on to block 108 where it is determined if a signal has been received by the controller 26 that is indicative that the vehicle frameless door 12 has been closed after being opened at block 106. If the signal that is indicative that the vehicle frameless door 12 has been closed has not been received by the controller 26, the method 100 recycles back to the beginning of block 108. If the signal that is indicative that the vehicle frameless door 12 has been closed has been received by the controller 26, the method 100 moves on to block 110 where the door window pane 14 is raised to the closed position 20 from the first partially open position 30.

Once the door window pane 14 is raised from the first partially open position 30 to the closed position 20 at block 110, the method moves on to block 112. At block 112 it is determined if a voltage of the battery 28, that is configured to power the regulator motor 24 that transitions the door window pane 14 between the closed position 20 and the fully open position 16, is less than a threshold value. In order to minimize any battery power used by the controller 26 while the vehicle 10 is shutdown, the controller 26 may be programmed to periodically (as opposed to continuously) measure the voltage of the battery 28 and compare the measured voltage to the threshold value at block 112. The controller 26 itself may shut down and only "wake up" periodically for short periods of time in order to measure the voltage of the battery 28 and compare the measured voltage to the threshold value at block 112 in order to minimize any battery power used by the controller 26. The controller 26 may utilize a debounce function (e.g., the controller may make take several voltage readings of the battery 28 during each period the controller is "up" and taking measurements) at block 112 in order to prevent the controller 26 from obtaining a false reading of a low or zero voltage, which may occur if the battery voltage operates according to a cyclical pattern, such as a sine function.

If the voltage of the battery 28 is not less than the threshold value, the method 100 recycles back to the beginning of block 112. If the voltage of the battery 28 is less than the threshold value, the method 100 moves on to block 114 where the door window pane 14 is lowered from the closed position 20 to the second partially open position 36. When the voltage of the battery 28 is less than the threshold value, the controller 26 anticipates that the power of battery 28 is likely to further decrease to a value where there will no longer be sufficient power to open the window pane 14, which will result in an interference between the window pane 14 and the vehicle frame 18 if the frameless door 12 were to be opened. Therefore, prior to any further decrease in the power of the battery 28, the controller 26 opens the window pane 14 to the second partially open position 36, which provides sufficient clearance between the window pane 14 and the vehicle frame 18 for opening the frameless door 12 and also minimizes any exposure of the interior of the vehicle 10 to the external conditions when compared to other partially opened positions, such as the first partially open position 30.

The window pane 14 may also be lowered from the closed position 20 to the second partially open position 36 at block 112 in response to the vehicle 10 being in a covered position or structure. The window pane 14 may also be lowered from the closed position 20 to the second partially open position 36 at block 112 in response to data indicative that the vehicle 10 has been placed into storage. Such data indicative of the vehicle is placed into storage may include a history of vehicle 10 (that may be recorded by the controller 26) not being operated during a specific time frame within a calendar year, the vehicle 10 not being operated after being shut down for a specific period of time, the vehicle not being operated after a specific period of time while also being in a covered position or structure, etc.

It should be understood that the flowchart in FIG. 2 is for illustrative purposes only and that the method 100 should not be construed as limited to the flowchart in FIG. 2. Some of the steps of the method 100 may be rearranged while others may be omitted entirely. It should also be understood that the designations of first, second, third, fourth, etc. for any component, state, or condition described herein may be rearranged in the claims so that they are in chronological order with respect to the claims. For Example, the fully open position 16, first partially open position 30, and second partially open position 36 may be referred to in the claims as the first open position, second open position, and third open position in any order.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

Parts List

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

vehicle 10
frameless door 12
window pane 14
open position 16
vehicle frame 18
position 20
sliding mechanism 22
regulator motor 24
controller 26
battery 28
first partially open position 30
limit switch 32
door handle 34
second partially open position 36
top of window 38
top of door 40
ignition switch 42
receiver 44
method 100
block 102
block 104
block 106
block 108
block 110
block 112
block 114

What is claimed is:

1. A vehicle door window controller comprising:

input channels configured to receive signals indicative of a position of a window pane that is disposed within a frameless door and a voltage of a battery that is configured to power a regulator motor to transition the window pane between at least a first and a second open position and a closed position;

an output channel configured to provide a command to adjust the position of the window pane from the closed position to the second open position that is between the first open position and the closed position; and control logic programmed to, in response to receiving signals indicative of the window pane being in the closed position and the voltage decreasing to less than a threshold, issue the command, and in response to receiving signals indicative of a vehicle shutdown and the window pane being in the closed position, periodically measure the voltage of the battery.

2. The vehicle door window controller of claim 1 further comprising:

secondary input channels configured to receive signals indicative of a vehicle shutdown and that the frameless door is about to be opened, and wherein the control logic is programmed to, in response to receiving the signal indicative that the frameless door is about to be opened during the vehicle shutdown, transition the window pane to a third open position that is between the second open position and the first open position.

3. The vehicle door window controller of claim 2 further comprising:

a tertiary input channel configured to receive a signal indicative that the frameless door has been closed, and wherein the control logic is programmed to, in response to receiving the signal indicative that the frameless door has been closed after being opened during the vehicle shutdown, transition the window pane from the third open position to the closed position.

4. The vehicle door window controller of claim 1, wherein the second open position is selected such that interference between the window pane and a vehicle frame is prevented when opening the frameless door.

5. The vehicle door window controller of claim 1, wherein the first open position corresponds to the window pane being fully opened.

6. The vehicle door window controller of claim 1, wherein a top of the window pane is disposed below a vehicle frame when the window pane is in the second open position.

7. The vehicle door window controller of claim 6, wherein the top of the window pane is disposed above the top of the frameless door when the window pane is in the second open position.

8. The vehicle door window controller of claim 1 further comprising:

a secondary input channel configured to receive a signal indicative of the vehicle being in a covered position, and wherein the control logic is programmed to, in response to receiving the signal indicative that the vehicle is in the covered position, transition the window pane to the second open position.

9. The vehicle door window controller of claim 1 further comprising:

a secondary input channel configured to receive a signal indicative that the vehicle has been placed into storage, and wherein the control logic is programmed to, in response to receiving the signal indicative that the vehicle that the vehicle has been placed into storage, transition the window pane to the second open position.

10. A vehicle door window controller programmed to:

in response to a voltage of a battery, that is configured to power a regulator motor, decreasing to less than a threshold and a window pane being in a closed position, transition the window pane to a first open position that is between a second open position and the closed position, wherein the window pane configured to be movable between at least the first and the second open position and the closed position, wherein the window pane is configured to extend upward from a top of a door and into a vehicle frame when the window pane is in the closed position, and wherein the regulator motor is disposed within the door and is configured to transition the window pane between the open positions and the closed position; and in response to receiving a signal indicative that the vehicle door is about to be opened during a vehicle shutdown, transition the window pane to a third open position that is between the second open position and the first open position.

11. The vehicle door window controller programmed of claim 10, wherein the controller is further programmed to: in response to receiving a signal indicative that the vehicle door has been dosed after being opened during the vehicle shutdown, transition the window pane from the third open position to the dosed position.

12. The vehicle door window controller programmed of claim 10, wherein the controller is further programmed to:

in response to a vehicle shutdown and the window pane being in the closed position, periodically measure the voltage of the battery.

13. A vehicle door window controller programmed to:

in response to a voltage of a battery that is configured to power a regulator motor decreasing to less than a threshold and a window pane being in a closed position, wherein the regulator motor is configured to transition the window pane between at least a first and a second open position and the closed position and the window pane is configured to extend upward from a frameless door and into a vehicle frame when in the closed position, operate the regulator motor to transition the window pane to the second open position that is between the first open position and the closed position; and in response to the vehicle being in a covered position, transition the window pane to the second open position.

14. The vehicle door window controller programmed of claim 13, wherein the controller is further programmed to:

in response to receiving a signal indicative that the frameless door is about to be opened during a vehicle shutdown, transition the window pane to a third open position that is between the second open position and the first open position.

15. The vehicle door window controller programmed of claim 14, wherein the controller is further programmed to:

in response to receiving a signal indicative that the frameless door has been closed after being opened during the vehicle shutdown, transition the window pane from the third open position to the closed position.

16. The vehicle door window controller programmed of claim 13, wherein the controller is further programmed to:

in response to a vehicle shutdown and the window pane being in the closed position, periodically measure the voltage of the battery.

17. The vehicle door window controller programmed of claim 13, wherein the controller is further programmed to:

in response to data indicative that the vehicle has been placed into storage, transition the window pane to the second open position.

18. A vehicle door window controller programmed to:

in response to a voltage of a battery that is configured to power a regulator motor decreasing to less than a threshold and a window pane being in a closed position, wherein the regulator motor is configured to transition the window pane between at least a first and a second open position and the closed position and the window pane is configured to extend upward from a frameless door and into a vehicle frame when in the closed position, operate the regulator motor to transition the window pane to the second open position that is between the first open position and the closed position; and in response to data indicative that the vehicle has been placed into storage, transition the window pane to the second open position.

* * * * *